US006067925A

United States Patent [19]

Little

[11] Patent Number: 6,067,925

[45] Date of Patent: May 30, 2000

[54] COLLAPSIBLE TRAILERLESS PONTOON BOAT

[76] Inventor: Mark Little, 2541 E. 2nd Ave., North St. Paul, Minn. 55109

[21] Appl. No.: 09/132,417

[22] Filed: Aug. 11, 1998

[51] Int. Cl.[7] ..... B63B 7/00

[52] U.S. Cl. ..... 114/354

[58] Field of Search ..... 114/343, 344, 114/352–354, 61.18

[56] References Cited

U.S. PATENT DOCUMENTS

| | | | |
|---|---|---|---|
| 2,876,728 | 3/1959 | Luger | 114/61.18 |
| 3,114,157 | 12/1963 | Stockmann | 114/61.18 |
| 4,023,222 | 5/1977 | Selby | 114/344 |

*Primary Examiner*—Ed Swinehart
*Attorney, Agent, or Firm*—D. L. Tschida

[57] ABSTRACT

A pontoon boat having a support framework that includes a number of telescoping cross members that laterally extend and retract to vary the width of the craft. Included tires rotate into and out of ground contact to permit towing without the need for a separate trailer. A motor or hand crank controls a longitudinal lead screw mounted to a reciprocating trailer tongue. Lateral control arms pivot with motion of the tongue member and laterally displace longitudinal side rails and flotation pontoons. A deck and handrails are raised and lowered as the framework reciprocates between travel and flotation positions. One of the sets of telescoping cross members separately rotates the tire support assemblies. A deck control assembly controls the alignment and separation of the deck at a longitudinal seam.

20 Claims, 7 Drawing Sheets

COLLAPSIBLE TRAILERLESS PONTOON BOAT

BACKGROUND OF THE INVENTION

The present invention relates to pontoon boats and, in particular, to a pontoon boat that collapses for towing and does not require a separate trailer.

Aquatic sport activities, including fishing and general boating, occupy significant amounts of the leisure time of many people. These activities can be shared by all family members and friends. Different types of watercraft have therefore been developed or improved to serve the demand. Personal watercraft and small, highly maneuverable powerboats have particularly experienced strong demand. Sales of runabouts, fishing boats, sailboats, paddleboats and boats of all types have also benefited.

Pontoon boats have also enjoyed strong growth. The ability of such craft to contain and transport large numbers of users in a relaxed, social atmosphere makes this type of watercraft very desirable to many owners. Occupant capacities of 1500 to 2000 pounds are common. Upholstered seating, cabinetry and other personal conveniences have made the crafts more appealing to a wider range of users. The watercraft is very stable and accommodates sun and weather covers to shelter users from inclement conditions. Changes to pontoon and frame design have also improved the maneuverability of the watercraft and permit water skiing and other towed water sports.

Although the size of the craft provides many advantages, the imposing size restricts the transportability of the craft. The boats typically measure 8 to 10 feet in width and 18 to 25 feet in length and can weigh 2500 to 3500 pounds. The lateral spacing of the pontoons and elevated decks frequently require special trailers to transport the craft. The craft can also be difficult to maneuver onto the trailers, especially under windy conditions. The physical dimensions can also make it difficult to trailer the craft over narrow or heavily traveled roads. Consequently, many craft are moored at marinas and docks and are only launched and removed from the water at the start and end of each boating season.

Efforts have been directed to designing a pontoon boat that disassembles. Two collapsible boats having inflatable pontoons are described at U.S. Pat. Nos. 5,651,706 and 4,562,786. An articulating pontoon float is also described at U.S. Pat. No. 4,730,574. The described craft are relatively small and accommodate a relatively few users.

The pontoon boat of the present invention was developed to provide an easily stored, mobile alternative to conventional pontoon watercraft. The assembly does not require a separate trailer. The integral framework facilitates launching and extraction by a single person, yet the craft accommodates large numbers of users, especially families. The portions of the framework that support transport are integrated into frame and do not appreciably add to weight or limit maneuverability.

SUMMARY OF THE INVENTION

It is accordingly a primary object of the invention to provide a pontoon-supported watercraft that integrates necessary trailer accessories into a support frame such that a separate trailer is not required to transport the craft.

It is a further object of the invention to provide a pontoon boat having a support framework that collapses laterally relative to a longitudinal seam and rotates travel wheels into ground contact to accommodate transport.

It is a further object of the invention to provide a pontoon boat having wheels mounted in-line to support pontoons that rotate between elevated and travel positions.

It is a further object of the invention to provide a pontoon boat having a lead screw drive assembly coupled to a sectional, telescoping trailer tongue assembly that reciprocates in response to drive rotation between travel and stowed positions.

It is a further object of the invention to provide lateral control arms to laterally displace longitudinal side frame rails.

It is a further object of the invention to provide wheel control arms and a telescoping wheel support assembly that rotates the wheels between the elevated and travel positions.

It is a further object of the invention to provide locking wheel support assemblies.

It is a further object of the invention to provide a linkage assembly that cooperates with the trailer tongue assembly to simultaneously rotate and raise or lower the deck and railings of the craft.

It is a further object of the invention to provide controls for monitoring and adjusting movement of the deck and/or extension of the trailer tongue assembly.

Various of the foregoing objects, advantages and distinctions of the invention are obtained in a presently preferred watercraft that provides a hinged deck which is supported from a collapsible framework that includes a reciprocating trailer tongue. A tire is supported in-line between a pair of pontoons mounted at each side of the craft. A lead screw drive assembly operates the trailer tongue and a set of lateral control arms cooperate to laterally extend and retract longitudinal side rails relative to a longitudinal center seam of the craft. Tire support control arms extend from the lateral control arms to rotate a tire support assembly. A deck control linkage cooperates with the rotation of the tire support assembly to align and control the deck at the longitudinal seam. Various controls monitor frame movement, latch the wheels and frame, control deck alignment and/or adjust the fitting between assemblies.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

DESCRIPTION OF THE PREFERRED EMBODIMENT

Figure 1:
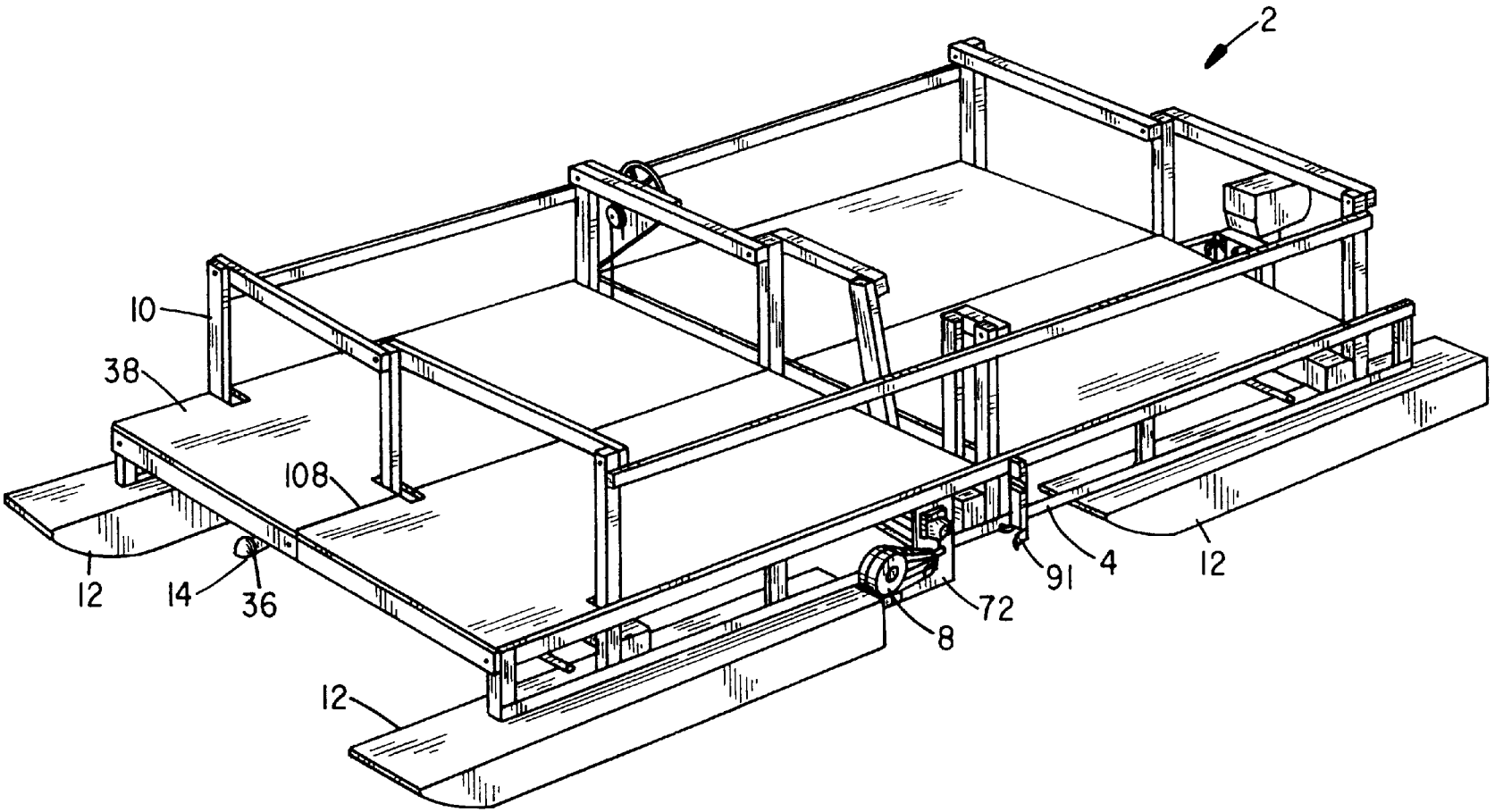
FIG. 1 is a perspective drawing of the pontoon watercraft of the invention.
Figure 2:
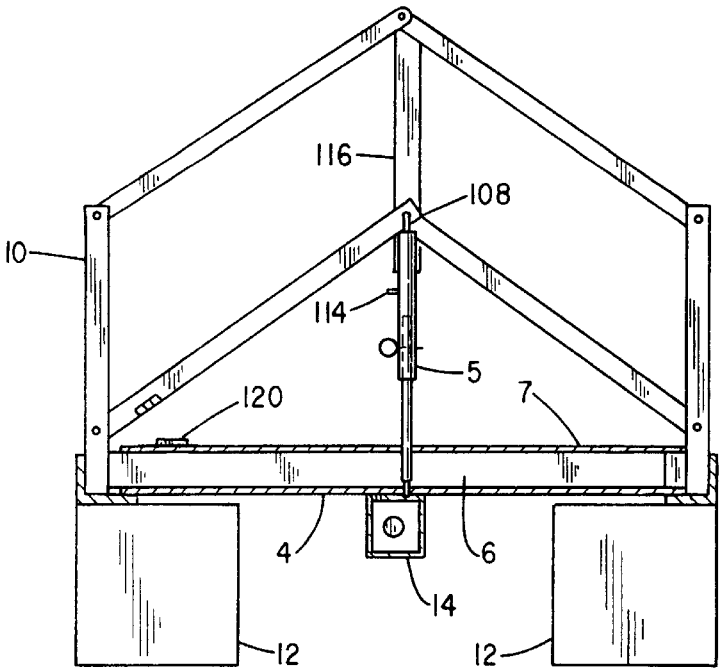
FIG. 2 is a front end view of the craft when collapsed for towing.
Figure 3:
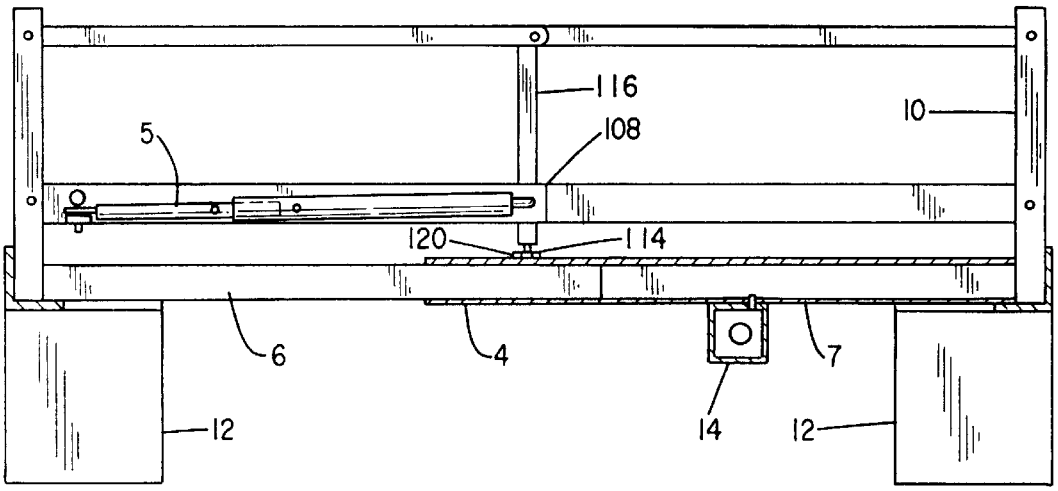
FIG. 3 is a front end view of the craft when extended for flotation.

Referring to FIGS. 1, 2 and 3, views are shown to the pontoon watercraft 2 of the invention. FIGS. 1 and 3 show views of the craft 2 as it appears when deployed for use and FIG. 2 shows the craft 2 collapsed for travel. The craft 2 includes a framework that is constructed to provide reciprocating lateral movement relative to a longitudinal seam at the deck 38. When collapsed, a number of sets of telescoping cross frame supports that include frame members 6 and 7 retract and a pair of tires 8 rotate into engagement with the ground. The width of the craft 2 is thereby reduced to a travel width of approximately seven feet, which allows the craft 2 to be safely trailered over most roadways.

A system of hinged handrails 10 simultaneously pivot and scissors with the deck 38 to an elevated travel position reference FIG. 2. With the frame 4 laterally extended, the height of the craft 2 from the ground to the top of the handrails 10 is nominally 4 feet. With the frame 4 retracted for travel, the maximum height at the handrails 10 is sized to permit travel beneath overpasses. A telescoping support arm assembly 5 is secured to the front of the framework 4 and mounts to a trailer tongue to support the framework 4 during travel, reference FIG. 3. The support assembly stows to the framework 4 during use of the craft 2.

The framework 4 can be designed to expand and retract to a variety of widths. A nominal extended width would be in the range of 8 to 12 feet and a retracted width would be in the range of 5 to 8 feet. The length of the craft 2 can also be adjusted as desired, and a length of 18 to 24 feet would be typical.

The craft 2 is supported by four flotation pontoons 12. The tires 8 are mounted in-line with and between a pair of the pontoons 12 at each side of the craft 2. An alternative arrangement is to mount the tires 8 inboard or outboard of two full-length pontoons 12.

Figure 4:
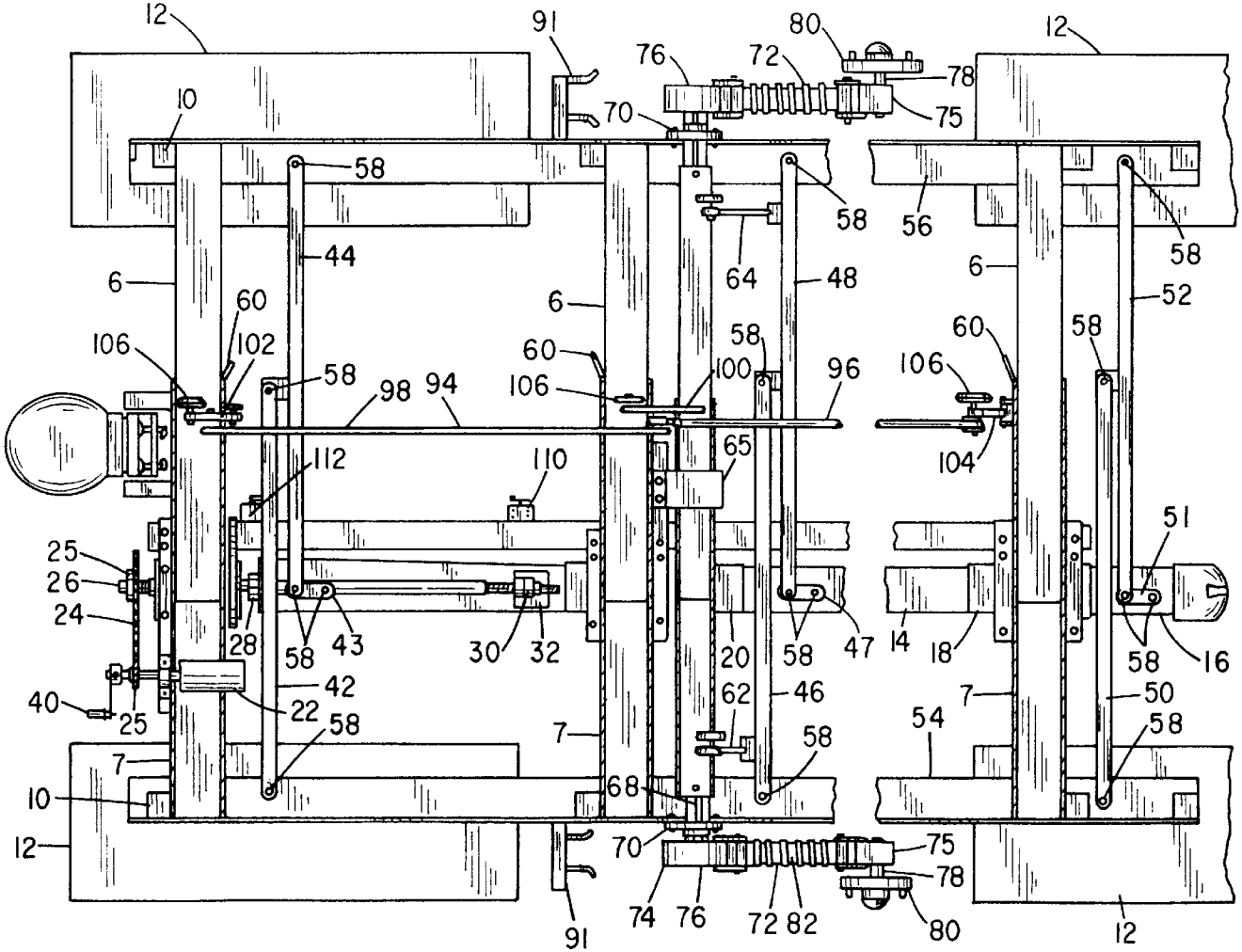
FIG. 4 is a top plan view of the operating support frame.

With attention to FIG. 4, a trailer tongue assembly 14 extends the longitudinal length of the craft 2. The tongue assembly 14 includes a tubular member 16 that extends and retracts through a pair of guides 18 and 20 mounted at center and forward cross members 7. A 12 volt motor 22 and chain drive 24 having a suitable gear ratio determined by supporting sprockets 25 drive a threaded lead screw 26 that is coupled to the member 16. A manual hand crank 40 can alternatively be mounted to the drive 24. The size of the motor 22 and gear ratio between the sprockets 25 can be varied as required, although a ¼ hp drill motor has been found sufficient to operate the framework 4 for the present craft 2.

Figure 5:
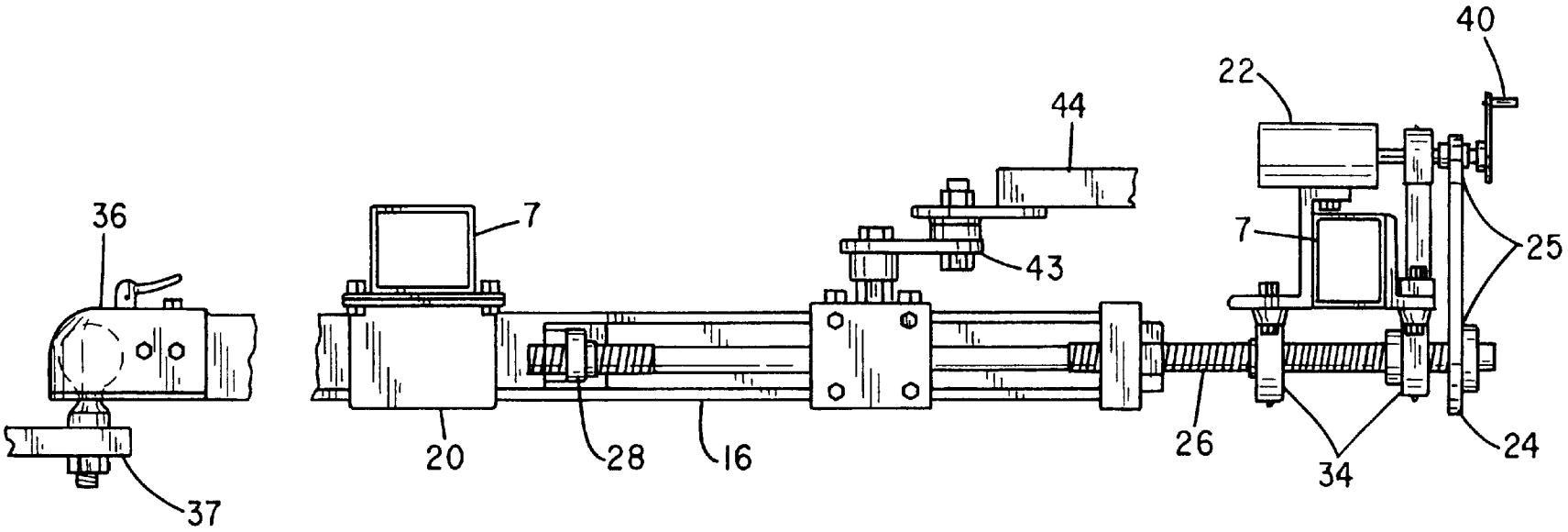
FIG. 5 is a side plan view shown in partial cutaway to the trailer tongue extension linkage.

The screw 26 is supported to the member 16 at an end carrier 28 and internal carrier 30. The internal carrier 30 reciprocates along a slide track 32 mounted to the bore of the member 16. A pair of pillow blocks 34 also support one end of the lead screw 26 to the aft cross member 7, reference FIG. 5.

Rotation of the drive chain 24 induces the member 16 to extend and retract a controlled distance. The member 16 moves approximately four feet for the present craft 2. In a travel position, a socket of a receiver 36 is extended to accept a trailer ball 37. In a stowed position, the receiver 36 is retracted beneath a deck 38. The deck 38 includes a number of cross support members (not shown) that maintain the rigidity of the deck. The deck 38 is also mounted to the framework 4 to not interfere with the operating assemblies described below.

Three sets of control arms 42, 43, 44; 46, 47, 48; and 50, 51, 52 are connected to the member 16 and right and left longitudinal side rails 54 and 56. A number of pivot joints 58 join the control arms 42-52 to each other, the member 16 and to the rails 54 and 56. As the member 16 is extended or retracted, the control arms 42–52 expand or retract the side rails 54 and 56 and pontoon 12 relative to a longitudinal centerline of the craft 2. The cross members 6 simultaneously reciprocate within the cross members 7. Plastic slide bearings 60 are mounted between the cross members 6 and 7 to facilitate the slide action between the members 6 and 7.

Figure 6:
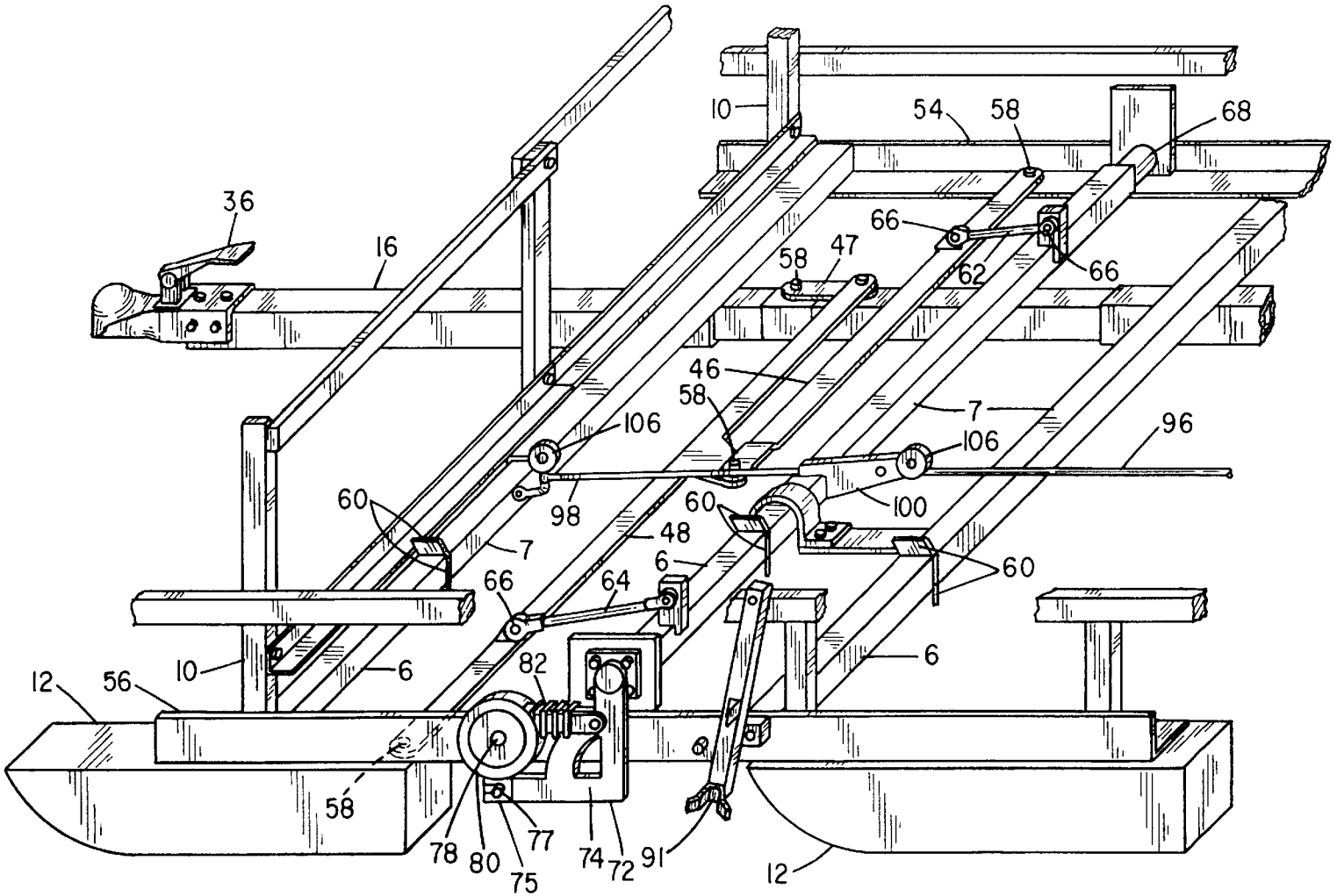
FIG. 6 is a partial perspective view of the control arm linkages that reciprocate the telescoping cross frame members, rotate the wheel support and rotate the deck control linkage.

With attention to FIG. 6, a separate pair of control arms 62 and 64 are respectively mounted between the control arm 46 and cross member 6 and control arm 48 and cross member 7. The ends of the control arms 46 and 48 are secured with ball-and-socket couplers 66. As the control arms 46 and 48 scissors with movement of the member 16, the control arms 62 and 64 cause the center set of telescoping cross members 6 and 7 to rotate within a support collar 65. Stub axle shafts 68 at the ends of the cross members 6 and 7 rotate in bearings 70 mounted to the side rails 54 and 56. The axle shafts 68 are keyed to tire support assemblies 72 that rotate adjacent the side rails 54 and 56. The assemblies 72 support the tires 8 and rotate the tires 8 between elevated or stowed and lowered or travel positions.

Figure 7:
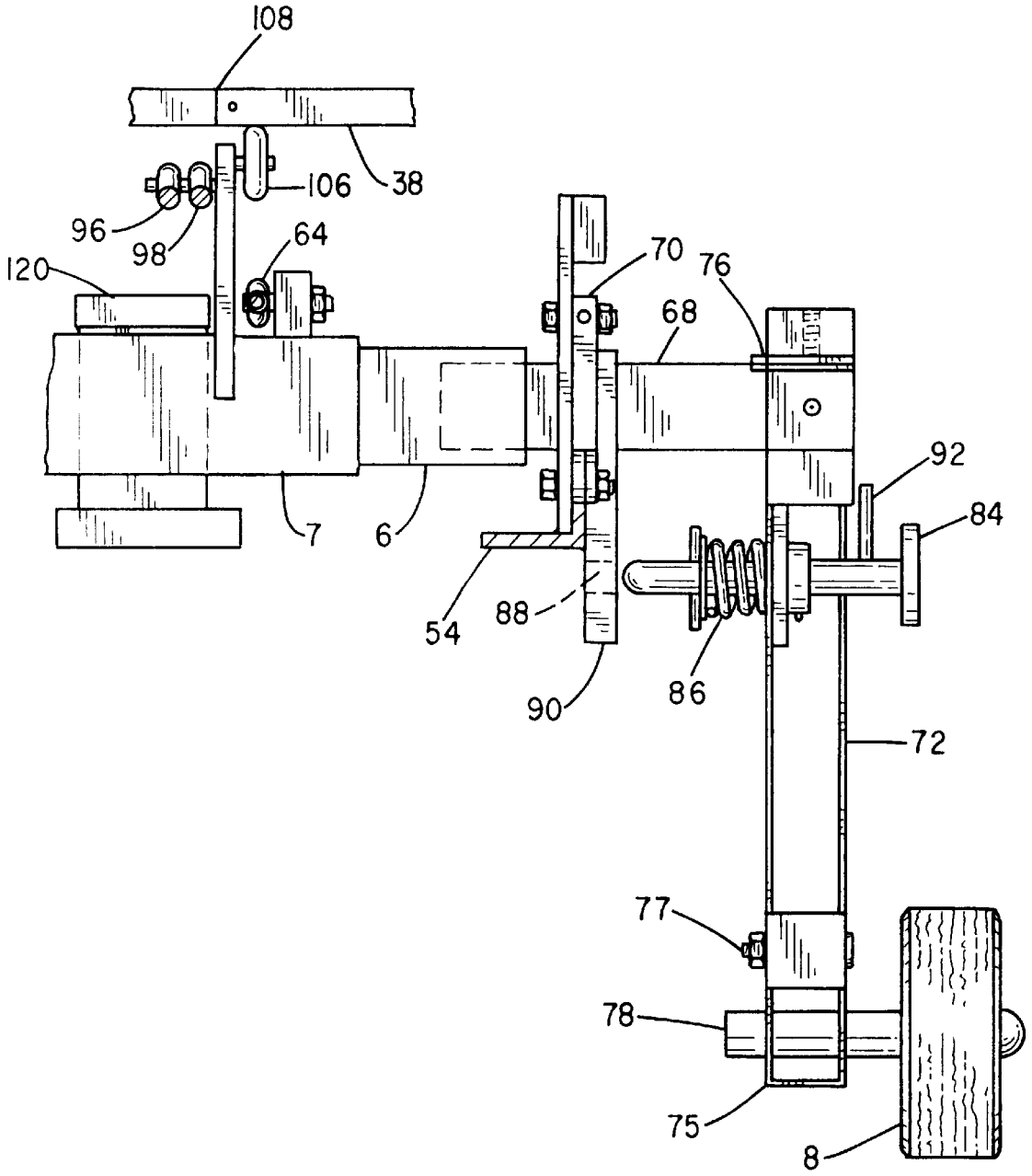
FIG. 7 is a partial end view of the wheel support and deck control assemblies.

The tire support assemblies 72 are also shown at FIG. 7. Each assembly 72 includes a support arm 74 that is secured to one of the stub axles 68 with a key 76. A separate stub axle 78 and backing plate assembly 80 mount to a pivot arm 75 that pivots at a pivot 77 at an end of the support arm 74. A shock absorber or other conventional suspension and/or torsion control device 82 is secured between the arms 74 and 75. When the support arm 74 is rotated to the travel position, a latch pin 84 which is biased with a spring 86 fits through a locking aperture 88 in a bracket 90 that depends from the rail 54 or 56. A cradle 91 also supports the arm 74. In the stowed position, the support arm 74 is held parallel to the rail 54 or 56 by a holding latch 92.

The tire support assemblies 72 are presently mounted outboard of the rails 54 and 56 and between two of the pontoons 12. Alternatively, the assemblies 72 can be mounted inboard of the rails 54 and 56 or outboard of the pontoons 12. If mounted inboard of the rails 54 and 56 and depending upon the size of the tires 8 and the separation of the deck 38 from the framework 4, the deck 38 may have to be modified to include cutouts and covers (not shown).

Figure 8:
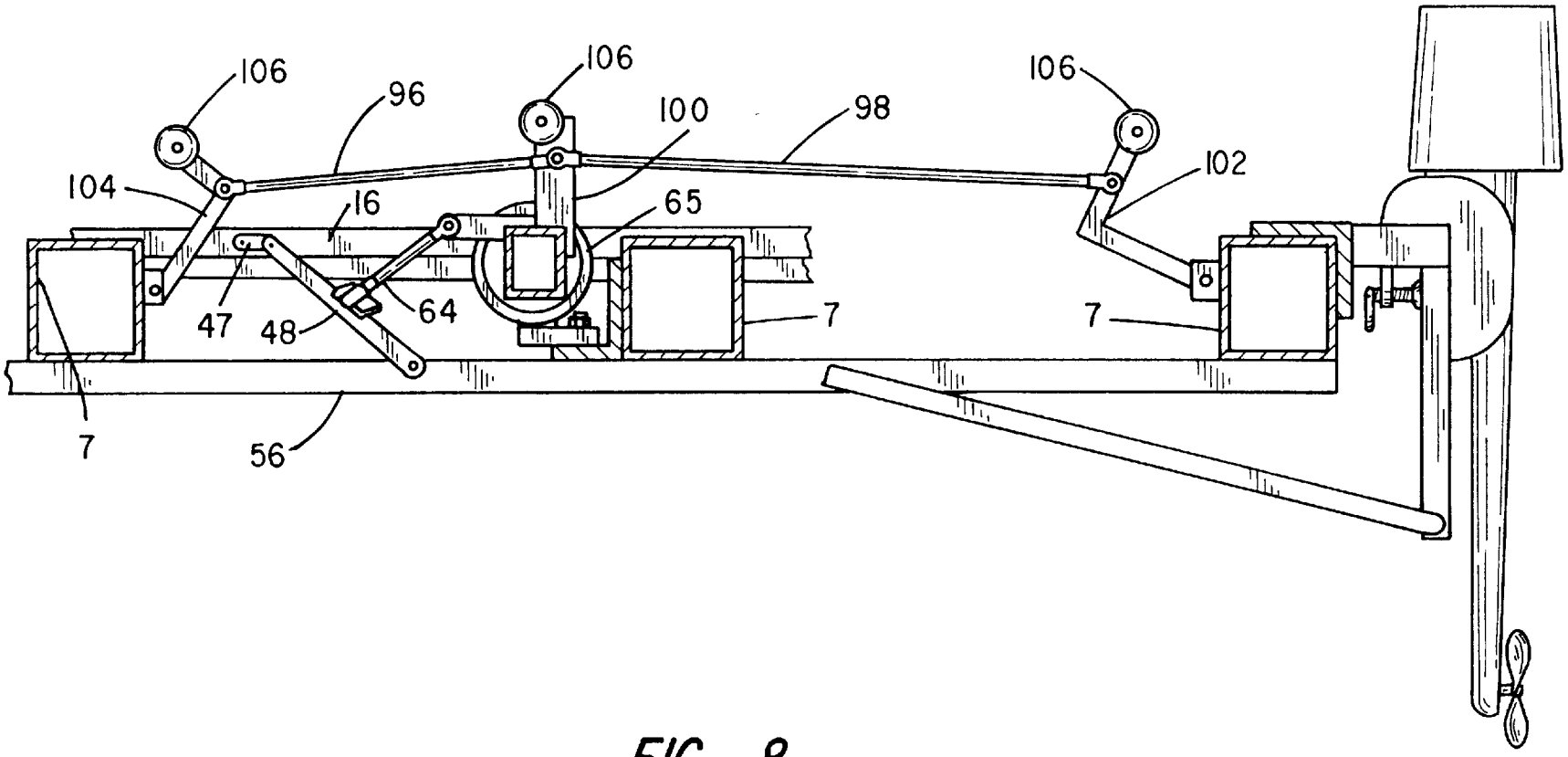
FIG. 8 is a longitudinal view to the deck control assembly.

Returning attention to FIGS. 4 and 6 and with additional attention to FIG. 8, a deck control assembly 94 is provided to control the raising and lowering of the deck 38. The assembly 94 includes a pair of length adjustable linkage arms 96 and 98 that extend from a lever arm 100 mounted to the center cross member 7. The linkage arms 96 and 98 extend to lever arms 102 and 104 that are mounted to pivot at the aft and forward cross members 7. A roller bearing or wheel 106 is mounted to each lever arm 100–104.

As the center cross member 7 rotates, the wheels 106 rotate into or out of contact with the underside of the deck 38. The deck 38, in turn, is induced to separate or re-align at a longitudinal seam 108. The seam 108 is positioned at the center of the craft 2. The lever arms 100–104 and wheels 106 thus provide support over the length of the deck 38 at the seam 108 and offset possible torsion or sticking forces at the seam 108. The portion of the handrails 10 that span the center of the craft 2 similarly assist in maintaining alignment of the framework 4, as well as supporting a steering wheel. A conventional steering linkage mounts between the steering wheel and motor.

Up and down limit switches 110 and 112 monitor movement of the framework 4 relative to the movement of the aft control arms 42 and 44. With the striking of either limit switch, the motor 22 is disengaged, until reset, to limit further framework motion. The down limit switch 112 is normally set such that motion of the deck 38 stops just prior to the seam 108 closing. Proper alignment at closure is obtained by adjusting the length of a pad 114 at a center, vertical handrail member 116, reference FIGS. 2 and 3. Shims 120 are also provided at the points of contact between the pads 114 at each of the vertical handrail members 116 with the cross members 7.

While the invention has been described with respect to a preferred construction and considered improvements or alternatives thereto, still other constructions may be suggested to those skilled in the art. The foregoing description should therefore be construed to include all those embodiments within the spirit and scope of the following claims.

What is claimed is:

1. A watercraft comprising:

a) a framework including a deck and a plurality of pontoons and wherein the deck is hinge mounted to pivot relative to the framework between a flotation position and a travel position;

b) a longitudinal frame member and means for coupling the longitudinal frame member to the framework for reciprocating movement in relation to the framework;

c) a plurality of cross frame supports coupled to said framework, wherein each cross frame support includes a plurality of members mounted for reciprocating movement in relation to one another, and wherein a plurality of first control arms couple said longitudinal frame member to each of said plurality of cross frame supports such that the framework laterally expands and contracts as said longitudinal member and said cross frame supports extend and retract to vary the width of the framework and pivot the deck, whereby in said flotation position the deck is rotated to lie parallel to the framework and in the travel position at least one longitudinal edge of the deck is elevated above the framework.

2. A watercraft as set forth in claim 1 wherein the longitudinal frame member is coupled to a lead screw and including a motor for rotating said lead screw to extend and retract said longitudinal frame member.

3. A watercraft as set forth in claim 1 including a plurality of tires and tire support means for rotating said plurality of tires, whereby the tires are raised above the bottom of the pontoons at said flotation position and lowered below the pontoons at said travel position.

4. A watercraft as set forth in claim 3 including means coupled to one of said cross frame supports for simultaneously rotating said tire support means as the width of the framework is varied.

5. A watercraft as set forth in claim 3 wherein a second control arm extends from one of the first control arms to rotate said tire support means includes longitiudinal frame member extends and retracts.

6. A watercraft as set forth in claim 3 wherein said tire support means includes means for latching said tires at the travel position.

7. A watercraft as set forth in claim 3 wherein said tire support means includes means for resiliently suspending said tires in the travel position.

8. A watercraft as set forth in claim 3 wherein a third control arm is coupled to said tire support means and includes a roller and wherein the third control arm rotates the roller into and out of engagement with the deck.

9. A watercraft as set forth in claim 1 including means for monitoring movement of said first control arms.

10. A watercraft comprising:

a) a framework including a deck having adjoining edges of first and second deck sections that define a lonyitudinal seam, a plurality of pontoons and a plurality of tires and wherein the first and second deck sections are hinge mounted to pivot at the longitudinal seam between a flotation position and a travel position;

b) a longitudinal frame member and a lead screw mounted to extend and retract the longitudinal frame member in reciprocating relation to the framework, and wherein a trailer coupler is mounted to the longitudinal frame member;

c) a plurality of cross frame supports coupled to said framework, wherein each cross frame support includes a plurality of members mounted for reciprocating movement in relation to one another, wherein a plurality of first control arms couple said longitudinal frame member to each of said plurality of cross frame supports such that the framework laterally expands and contracts as said longitudinal frame member and said cross frame supports extend and retract to vary the width of the framework and pivot the deck, and wherein a plurality of second control arms extend from the plurality of first control arms and are mounted to rotate one of said plurality of cross frame supports as the longitudinal frame member extends and retracts; and d) tire support means mounted to said plurality of tires and the rotating one of said cross frame supports and moveable between said travel and flotation positions, whereby in said flotation position the first and second sections are rotated to lie parallel to the framework with the tires raised above the bottom of said pontoons and with the trailer coupler retracted and in said travel position the edges of said first and second deck sections at said longitudinal seam are rotated and elevated above the framework with the tires lowered below the pontoons and with the trailer coupler extended for mounting to a towing vehicle.

11. A watercraft as set forth in claim 10 wherein said tire support means includes means for latching said tires at the travel position.

12. A watercraft as set forth in claim 10 wherein a plurality of third control arms include a plurality of rollers and wherein the third control arms are coupled to at least one of said plurality of cross frame supports to rotate the rollers into and out of engagement with the deck.

13. A watercraft as set forth in claim 10 including means for monitoring movement of said first control arms.

14. A watercraft as set forth in claim 10 including means for supporting said first and second deck sections when elevated in the travel position.

15. A watercraft comprising:

a) a framework including a deck having adjoining edges of first and second deck sections that define a longitudinal seam, a plurality of pontoons, a plurality of tires and a plurality of railing members and wherein the first and second sections and railing members are hinge mounted to pivot at the longitudinal seam between a flotation position and a travel position;

b) a longitudinal frame member and a lead screw mounted to extend and retract the longitudinal frame member in reciprocating relation to the framework, and wherein a trailer coupler is mounted to the longitudinal frame member;

c) a plurality of cross frame supports coupled to said framework, wherein each cross frame support includes a plurality of members mounted for reciprocating movement in relation to one another, wherein a plurality of first control arms couple each of said plurality of cross frame supports to said longitudinal frame member such that the framework laterally expands and contracts as said cross frame supports extend and retract to vary the width of the framework and pivot the deck, and wherein a plurality of second control arms extend from the plurality of first control arms and are mounted to rotate one of said plurality of cross frame supports as the longitudinal frame member extends and retracts;

d) a plurality of third control arms coupled to the rotating one of said plurality of cross frame supports and including a plurality of rollers and wherein rotation of the rotating one of said cross frame supports rotates the rollers to separate the first and second deck sections at the longitudinal seam; and e) tire support means mounted to said plurality of tires and the rotating one of the cross frame supports and moveable between said travel and flotation positions and wherein said tire support means includes means for latching said tires at the travel position, whereby in said flotation position the first and second sections are rotated to lie parallel to the framework with the tires raised above the bottom of said pontoons and with the trailer coupler retracted and in said travel position the edges of said first and second deck sections at said longitudinal seam are rotated and elevated above the framework with the tires lowered below the pontoons and with the trailer coupler extended for mounting to a towing vehicle for mounting to a towing vehicle in the travel position.

16. A watercraft as set forth in claim 15 including a motor, a plurality of sprockets and means for coupling the sprockets to rotate the lead screw.

17. A watercraft as set forth in claim 15 wherein the tire support means includes first and second tire supports mounted between a pair of pontoons secured to opposite sides of the framework.

18. A watercraft as set forth in claim 15 wherein a plurality of sleeves mounted to the cross frame supports support said longitudinal frame member.

19. A watercraft as set forth in claim 15 including a plurality of slide bearings mounted between the members of said cross frame support and between said longitudinal frame member and the framework.

20. A watercraft as set forth in claim 15 wherein said third control alms are coupled to the rotating one of the cross frame supports.

* * * * *